US010549944B2

(12) United States Patent
Ishikawa et al.

(10) Patent No.: US 10,549,944 B2
(45) Date of Patent: Feb. 4, 2020

(54) PAPER-MADE REEL

(71) Applicant: SMC CORPORATION, Chiyoda-ku (JP)

(72) Inventors: Yasuo Ishikawa, Koshigaya (JP); Takashi Tozaki, Koshigaya (JP)

(73) Assignee: SMC CORPORATION, Chiyoda-ku (JP)

( * ) Notice: Subject to any disclaimer, the term of this patent is extended or adjusted under 35 U.S.C. 154(b) by 208 days.

(21) Appl. No.: 15/737,054

(22) PCT Filed: Jun. 8, 2016

(86) PCT No.: PCT/JP2016/067012
§ 371 (c)(1),
(2) Date: Dec. 15, 2017

(87) PCT Pub. No.: WO2016/204032
PCT Pub. Date: Dec. 22, 2016

(65) Prior Publication Data

US 2018/0155153 A1 Jun. 7, 2018

(30) Foreign Application Priority Data

Jun. 18, 2015 (JP) ..... 2015-122923

(51) Int. Cl.
*B65H 75/14* (2006.01)
*B65H 75/20* (2006.01)
*B65H 75/22* (2006.01)

(52) U.S. Cl.
CPC ..... *B65H 75/14* (2013.01); *B65H 75/20* (2013.01); *B65H 75/22* (2013.01)

(58) Field of Classification Search
CPC ..... B65H 75/14; B65H 75/20; B65H 75/22; B65H 2701/5112; B65H 2701/513
See application file for complete search history.

(56) References Cited

U.S. PATENT DOCUMENTS 1,205,906 A * 11/1916 Kuehn ..... B65H 75/14 242/118.7
2,112,209 A * 3/1938 Goldsmith ..... B65H 75/14 242/610.2

(Continued)

FOREIGN PATENT DOCUMENTS

JP 63-21672 U 2/1988
JP 2-4864 U 1/1990

(Continued)

OTHER PUBLICATIONS

International Search Report dated Aug. 9, 2016 in PCT/JP2016/067012 filed Jun. 8, 2016.

*Primary Examiner* — William A. Rivera
(74) *Attorney, Agent, or Firm* — Oblon, McClelland, Maier & Neustadt, L.L.P.

(57) ABSTRACT

A paper-made reel includes an impeller-like winding drum made of paper, and flange plates made of paper attached to one end and the other end of the winding drum, the winding drum includes a hollow shaft portion core, and a plurality of blade portions extending in radial directions from the shaft portion core, the shaft portion core and the blade portions are integrally formed by folding a sheet, the blade portions are formed in a state where the sheet is double-folded, and the winding drum and the flange plates are connected to each other by locking locking pieces formed at both ends of the winding drum to the flange plates.

8 Claims, 9 Drawing Sheets

(56) References Cited

U.S. PATENT DOCUMENTS

| | | | | | |
|---|---|---|---|---|---|
| 2,380,641 | A * | 7/1945 | Freiler | B65H 75/14 | 242/610.1 |
| 2,799,458 | A * | 7/1957 | Nye | B65H 75/14 | 242/118.8 |
| 2,852,206 | A * | 9/1958 | Bolding | B65H 75/22 | 242/118.8 |
| 3,817,475 | A * | 6/1974 | Goldstein | B65H 75/22 | 242/607.1 |
| 3,876,073 | A * | 4/1975 | Herbetko | B65D 85/04 | 242/608.7 |
| 3,958,775 | A * | 5/1976 | Liga | B65H 75/14 | 242/118.8 |
| 5,513,819 | A * | 5/1996 | Orange | B65H 75/22 | 242/118.8 |
| 5,791,590 | A * | 8/1998 | Zuk | B65H 75/22 | 242/608.7 |
| 6,575,398 | B2 * | 6/2003 | Nakamura | B65H 75/22 | 242/118.61 |
| 7,575,189 | B2 * | 8/2009 | Shirazi | B65D 85/04 | 242/588 |
| 8,480,024 | B2 * | 7/2013 | Ries | B65H 75/14 | 242/608.7 |
| 8,882,017 | B2 * | 11/2014 | Woods | B65H 75/22 | 242/127 |
| 9,556,000 | B2 * | 1/2017 | Carman | B65H 75/14 | |

FOREIGN PATENT DOCUMENTS

| | | | |
|---|---|---|---|
| JP | 5-61178 | U | 8/1993 |
| JP | 11-157752 | A | 6/1999 |
| JP | 2003-155167 | A | 5/2003 |
| JP | 2006-213439 | A | 8/2006 |
| JP | 2014-185032 | A | 10/2014 |

* cited by examiner

PAPER-MADE REEL

TECHNICAL FIELD

The present invention relates to a paper-made reel used for winding a flexible linear body such as a tube, a hose, or an electric wire.

BACKGROUND ART

A paper-made reel used for winding a flexible linear body such as a tube, a hose, or an electric wire is publicly known as disclosed in, for example, PTLs 1 to 4.

This reel is formed of paper such as corrugated cardboard or thick paper, has a cylindrical winding drum for winding the flexible linear body, and flange plates attached to both ends in the axial direction of the winding drum, and has the advantage that disposal after use is easy. However, since the strength of the winding drum and a core is weak, various contrivances have been made to enhance the strength.

For example, in the reel disclosed in PTL 1, the strength of the reel is increased by forming the winding drum in an inner and outer double structure. In the reel disclosed in PTL 2, a plurality of annular reinforcing plates are fitted into the inner central position of the winding drum, and the winding drum is supported from the inside by the reinforcing plates.

In the reel disclosed in PTL 3, a support member having a square hollow shape is formed by folding corrugated cardboard, this support member is inserted into a cylindrical winding drum and is caused to support from the inside, and the strength of the winding drum is thereby enhanced.

The winding drum of the reel disclosed in PTL 4 is formed by fitting a plurality of annular reinforcing partition plates on the outer periphery of a cylindrical shaft portion core at a regular interval, and wrapping a cylindrical reinforcing shaft core around the outer peripheries of the reinforcing partition plates.

However, in the reels disclosed in PTLs 1 to 3, the strength of the cylindrical winding drum has not been improved to such an extent that it can sufficiently withstand the large tightening force acting through the linear body at the time of winding or unreeling of the linear body. In addition, they have a problem in that it is structurally difficult to uniformly increase the strength of the winding drum over the entire axial direction. Room for further improvement is left.

On the other hand, in the case of the reel disclosed in PTL 4, the strength of the winding drum is considered to be high compared to the reels disclosed in PTLs 1 to 3. However, since the winding drum is formed by combining many separately formed components including the shaft portion core, there is a disadvantage that the structure is complicated and the assembly work is complicated.

CITATION LIST

Patent Literature

PTL 1: Japanese Unexamined Patent Application Publication No. 2003-155167

PTL 2: Japanese Unexamined Patent Application Publication No. 2014-185032

PTL 3: Japanese Unexamined Utility Model Registration Application Publication No. 5-61178

PTL 4: Japanese Unexamined Patent Application Publication No. 2014-133653

SUMMARY OF INVENTION

Technical Problem

A technical object of the present invention is to provide a paper-made reel which has a greater strength of the winding drum and the shaft portion core compared with the conventional reel, is simple in construction and easy to assemble.

Solution to Problem

To solve the above problem, a paper-made reel of the present invention includes an impeller-like winding drum made of paper for winding a flexible linear body; and flange plates made of paper attached to one end and the other end in the direction of the axis of the winding drum. The winding drum has a hollow shaft portion core, and a plurality of blade portions extending in radial directions from the outer periphery of the shaft portion core. The shaft portion core and the blade portions are integrally formed by folding a sheet cut into such a shape that shaft pieces forming the shaft portion core and pairs of blade pieces forming the blade portions are alternately continued. The shaft portion core is formed in a hollow shape by disposing the shaft pieces around the axis with adjacent shaft pieces in contact with each other. The blade portions are formed by double-folding the pairs of blade portions, and extend along the axis and over the entire length of the shaft portion core. Locking pieces for connection are formed at both ends in the axial direction of the winding drum, and the winding drum and the flange plates are connected by locking the locking pieces to the flange plates.

In the present invention, it is preferable that the width of the shaft pieces be less than the height of the blade portions extending from the shaft portion core, and the diameter of an imaginary circumscribed circle circumscribing the shaft portion core be also less than the height of the blade portions.

In the present invention, the pair of blade pieces forming each blade portion are held in a state of being overlapped with each other by locking a tongue piece formed in one of the blade pieces to the other blade piece.

In this case, it is preferable that the tongue pieces be formed at positions that face each other of the pair of blade pieces, the tongue pieces of the pair of blade pieces be folded toward either one of the blade pieces while being overlapped with each other, the tongue piece of one of the blade pieces be thereby locked to the other blade piece, and the pair of blade pieces be held in a state of being overlapped with each other, and it is more preferable that the tongue pieces be formed at a plurality of positions of each blade portion.

In the present invention, the locking pieces are formed at both side end portions of the pair of blade pieces and have locking portions at their distal ends. In the flange plate, insertion holes into which the proximal end portions of the locking pieces are inserted and locking holes into which the locking portions are inserted are alternately formed around the axis. The locking pieces of the blade pieces are inserted into the insertion holes of the flange plate from the inside to the outside of the flange plate and are then folded in the directions of the locking holes, the locking portions at the distal ends of the locking pieces are inserted into the locking holes from the outside to the inside of the flange plate, and the winding drum and the flange plate are thereby connected to each other.

In this case, it is preferable that the number of the insertion holes of the flange plate and the number of the locking hole of the flange plate be equal to the number of the blade portions, and be equal to each other, the proximal end portions of the two locking pieces formed in the pair of blade pieces in each blade portion be inserted together into one of the insertion holes while being overlapped with each other, the locking portions at the distal ends of the two locking pieces be separately inserted into the locking holes located on both sides of the insertion hole, and be inserted together with the locking portion of the locking piece formed in one of the pair of blade pieces in the adjacent blade portion.

In the present invention, a cylindrical body made of paper may be attached to the outer periphery of the winding drum so as to surround the distal ends of the plurality of blade portions.

Advantageous Effects of Invention

According to the present invention, the winding drum of the reel has an impeller-like shape and has a plurality of blade portions extending in radial directions from a central hollow shaft portion core and the linear body is wound so as to surround the blade portions. Therefore, the strength against the tightening force of the linear body is significantly high compared to a conventional reel in which the winding drum is cylindrical, and there is no possibility of causing deformation. Since the shaft portion core and the blade portions are integrally formed by bending one sheet in which shaft pieces forming the shaft portion core and pairs of blade pieces forming the blade portions are alternately continued, the structure is simple and assembly is easy compared to the case where a reel is formed by combining a plurality of separately formed components.

DESCRIPTION OF EMBODIMENTS

FIGS. 1 to 12 show an embodiment of a paper-made reel according to the present invention. The reel 1A of the first embodiment includes an impeller-like winding drum 2 for winding a flexible linear body such as a tube, a hose, or an electric wire, and flange plates 3 attached to one end and the other end in the direction of the axis L of the winding drum 2. The winding drum 2 and the flange plates 3 are formed of paper such as corrugated cardboard or thick paper. In this embodiment, corrugated cardboard is used as the paper. This corrugated cardboard is made by bonding flat paperboards to both sides of corrugated core paper, and usually has a thickness of about 3 to 4 mm.

Figure 2:
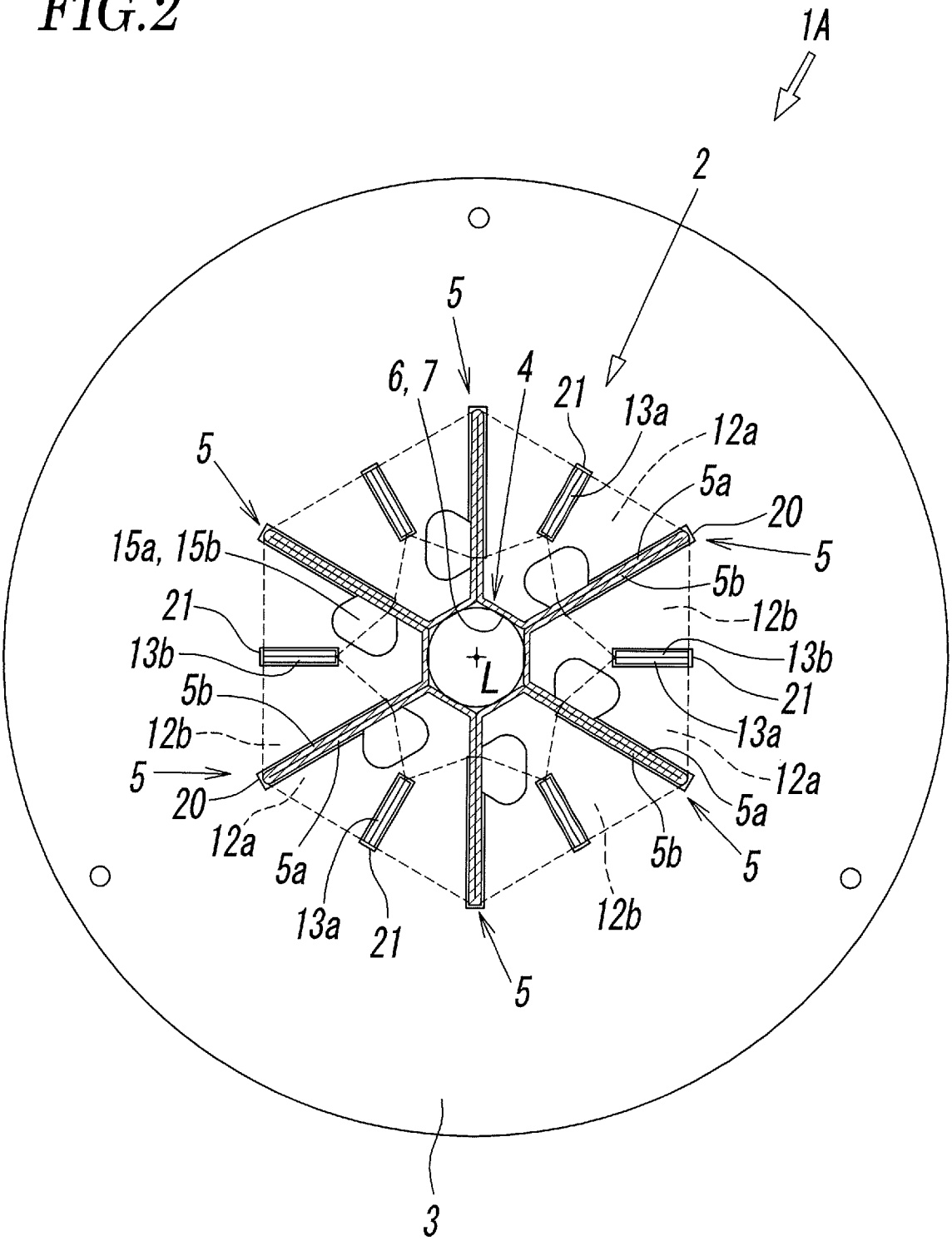
FIG. 2 is an enlarged sectional view of FIG. 1.
Figure 6:
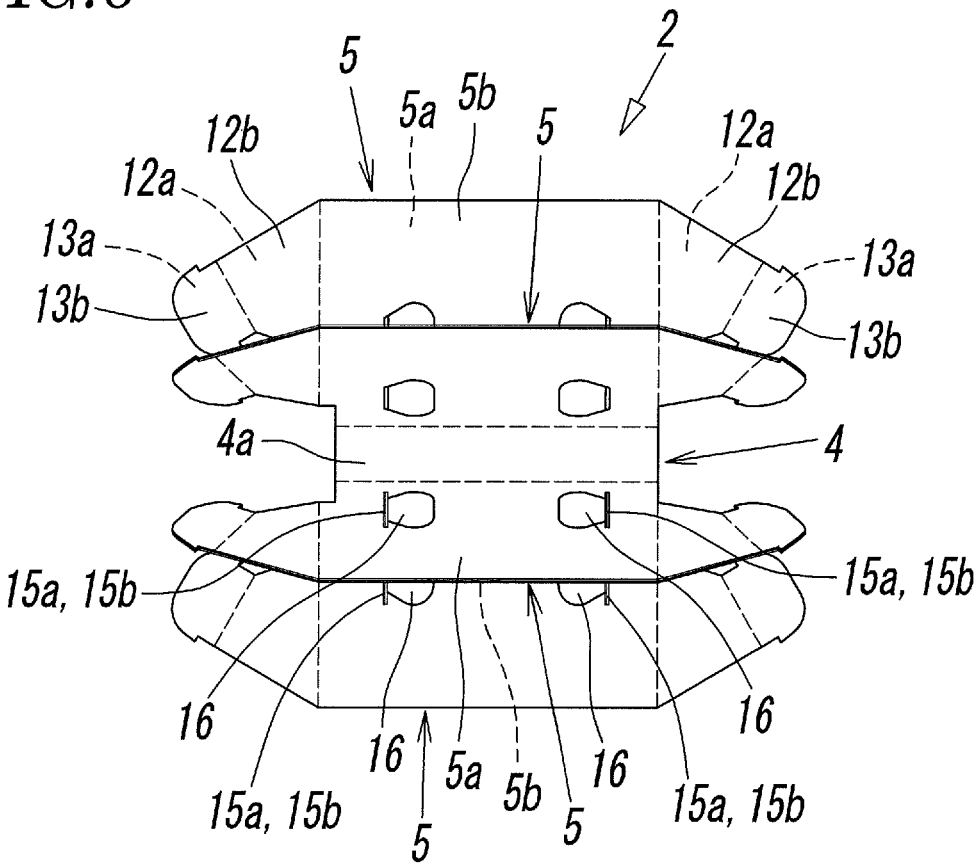
FIG. 6 is a front view of a winding drum formed by folding the sheet.
Figure 7:
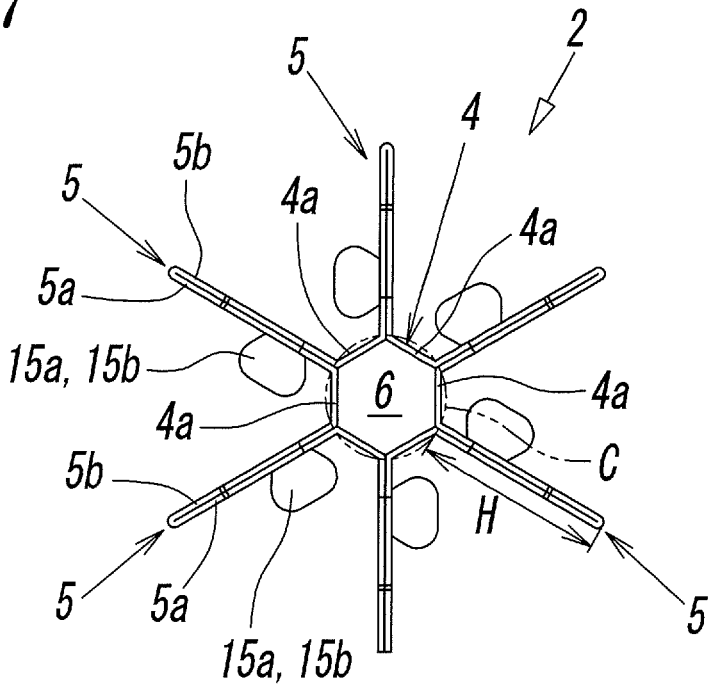
FIG. 7 is a left side view of FIG. 6.

As can be seen in FIGS. 2, 6, and 7, the winding drum 2 includes a hollow shaft portion core 4 surrounding a central hole 6, and a plurality of plate-like blade portions 5 extending from the outer periphery of the shaft portion core 4 at equal angles in the radial directions. The blade portions 5 are connected to the outer periphery of the shaft portion core 4 parallel to the axis L along the axis L and extend over the entire length of the shaft portion core 4.

Figure 3:
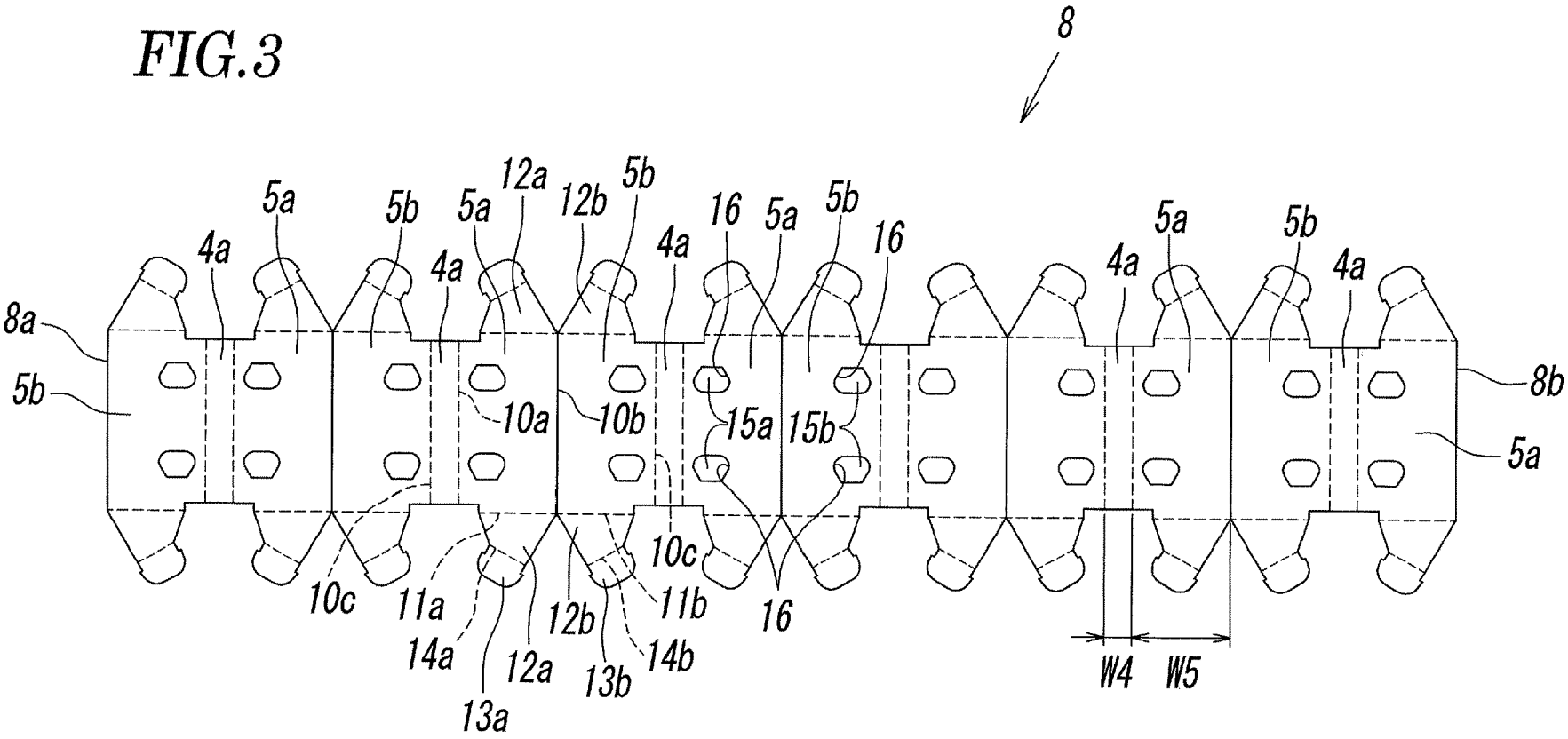
FIG. 3 is a development view of a sheet forming a winding drum.

The shaft portion core 4 and the blade portions 5 are integrally formed by folding a sheet 8 of corrugated cardboard cut into the shape shown in FIG. 3.

The sheet 8 is such that a plurality of elongate rectangular shaft pieces 4*a* forming a part of the outer periphery of the shaft portion core 4, and a plurality of pairs of rectangular blade pieces 5*a*, 5*b* forming the blade portions 5, are alternately connected via folding lines 10*a*, 10*b*, and 10*c*. When one of the pair of blade pieces 5*a* and 5*b* is a first blade piece 5*a* and the other is a second blade piece 5*b*, such a form that the shaft piece 4*a* and the first blade piece 5*a* are continuous via the folding line 10*a*, the first blade piece 5*a* and the second blade piece 5*b* are continuous via the folding line 10*b*, and the second blade piece 5*b* and the shaft piece 4*a* are continuous via the folding line 10*c*, is repeated a plurality of times.

A pair of blade pieces 5*a*, 5*b* that form one of the blade portions 5 are separated and separately connected to one end (first end) 8*a* and the other end (second end) 8*b* in the longitudinal direction of the sheet 8. That is, the second blade piece 5*b* is connected to a first end 8*a* of the sheet 8, and the first blade piece 5*a* is connected to a second end 8*b* of the sheet 8.

The width W5 of the blade pieces 5*a*, 5*b* is greater than the width W4 of the shaft pieces 4*a* and, in the illustrated example, is about three times the width W4 of the shaft pieces 4*a*.

Locking pieces 12*a*, 12*b* are connected to both ends in the longitudinal direction (the direction of the axis L) of the pair of blade pieces 5*a* and 5*b* via folding lines 11*a* and 11*b*. Tongue pieces 15*a*, 15*b* widening toward the distal ends thereof and surrounded by substantially C-shaped cuts 16 are formed at positions of the middle parts of the blade pieces 5*a*, 5*b* that face each other when folded. Although the tongue pieces 15*a*, 15*b* are provided at a plurality of positions (two positions in the figure) in a direction along the axis L, the formation positions thereof are arbitrary, and may be one position.

The locking pieces 12*a*, 12*b* are formed in such a shape that the lateral width gradually decreases away from the blade pieces 5*a*, 5*b*. The locking portions 13*a*, 13*b* are obliquely connected to the distal ends thereof via folding lines 14*a*, 14*b* that are inclined with respect to the folding lines 11*a*, 11*b*. The direction in which the locking portions 13*a*, 13*b* are inclined is a direction in which locking portions 13*a*, 13*b* of a pair of blade pieces 5*a*, 5*b* are separated from each other. The locking portions 13*a*, 13*b* are parts of the locking pieces 12*a*, 12*b*.

The pair of blade pieces 5*a*, 5*b* including the tongue pieces 15*a*, 15*b* and the locking pieces 12*a*, 12*b* have the same shape. Therefore, when the pair of blade piece 5*a*, 5*b* are folded in two at the position of the folding line 10*b*, the whole overlaps perfectly.

Figure 4:
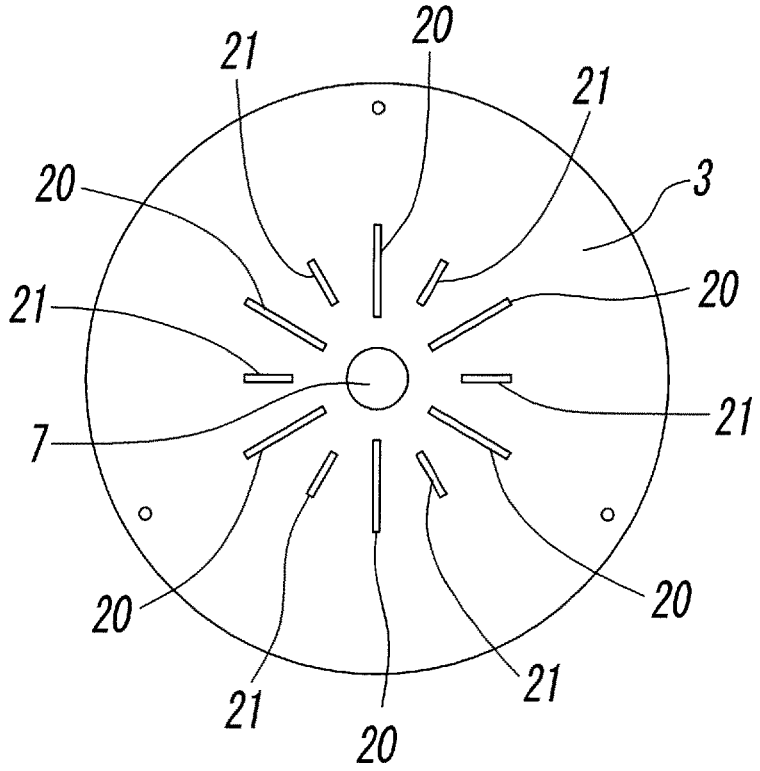
FIG. 4 is a front view of a flange plate.

On the other hand, the flange plates 3 are circular as shown in FIG. 4. In the center thereof, a circular central hole 7 for inserting a reel supporting rod is formed so as to communicate with the central holes 6 of the winding drum 2. Around the central hole 7, slit-like insertion holes 20 into which the proximal end portions of the locking pieces 12*a*, 12*b* are inserted, and slit-like locking holes 21 into which the locking portions 13*a*, 13*b* are inserted are formed around the central hole 7 (axis L) at equal central angles alternately and in radial directions. The length of the insertion holes 20 is substantially the same as the width of the proximal end portions of the locking pieces 12*a*, 12*b*, and the length of the locking holes 21 is substantially the same as the width of the locking portions 13*a*, 13*b*. Therefore, the length of the insertion holes 20 is greater than the length of the locking holes 21. The number of the insertion holes 20 and the number of the locking holes 21 are equal to each other and are equal to the number of the blade portions 5, and six in the illustrated example.

The reel 1A is formed by the sheet 8 and the flange plates 3, 3 as follows.

Figure 5:
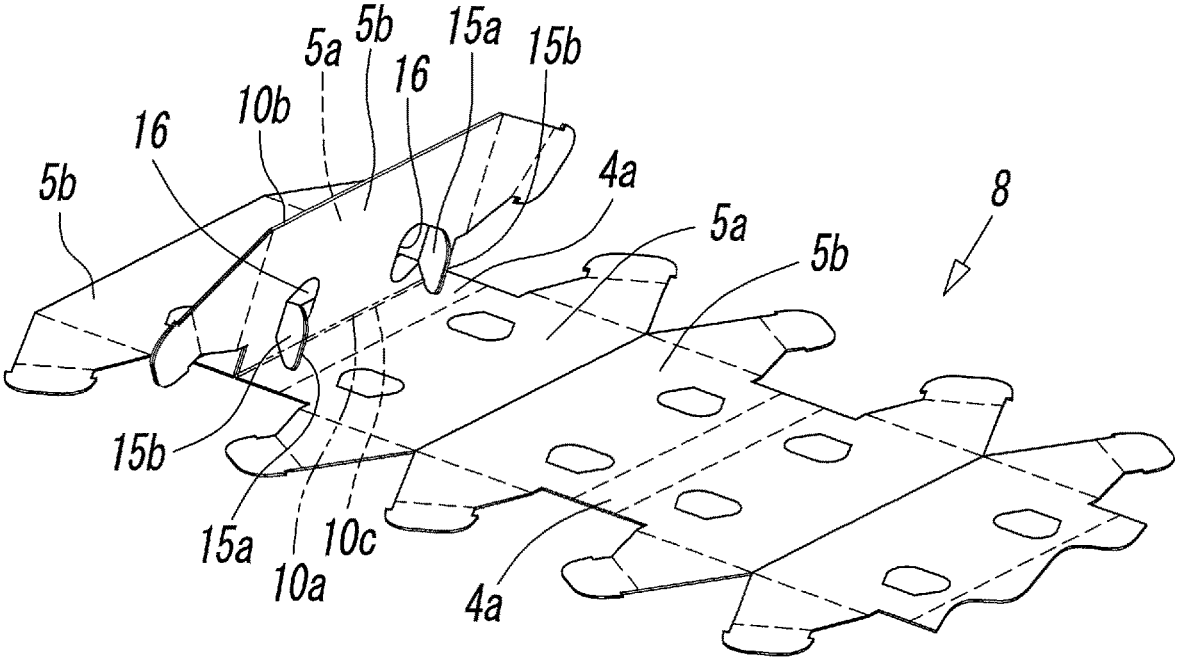
FIG. 5 is a perspective view of essential parts for explaining a process of folding the sheet of FIG. 3 to form a winding drum.

That is, first, as shown in FIG. 5, a pair of blade pieces 5*a*, 5*b* of the sheet 8 are double-folded by folding at the position of the folding line 10*b*, and the blade pieces 5*a*, 5*b* are folded at the positions of the folding lines 10*a*, 10*c* to be in a state of rising with respect to the shaft piece 4*a*. Then, the tongue pieces 15*a*, 15*b* of the folded pair of blade pieces 5*a* and 5*b* are folded toward either one of the blade pieces 5*a* or 5*b*, and the pair of blade pieces 5*a*, 5*b* are thereby held in a state of being overlapped with each other. In the illustrated example, the tongue pieces 15*a*, 15*b* are folded toward the second blade piece 5*b*.

At this time, since the tongue pieces 15*a*, 15*b* widen toward the distal ends thereof, and the cuts 16 have the same shape and function as locking holes, when the two tongue pieces 15*a*, 15*b* are folded toward the second blade piece 5*b* while being overlapped with each other, the tongue piece 15*a* of the first blade piece 5*a* fits in the cut 16 of the second blade piece 5*b* and is locked to the cut 16, and the pair of blade pieces 5*a*, 5*b* are thereby held in a state of being overlapped with each other. If the two tongue pieces 15*a*, 15*b* are folded on the outer surface side of one of the blade pieces 5*a* or 5*b*, the locking effect to the cut 16 is further improved.

The above-described work is performed for all the blade pieces 5*a*, 5*b* and the shaft pieces 4*a*. Thereafter, for the first blade piece 5*a* and the second blade piece 5*b* respectively connected to one end 8*a* and the other end 8*b* of the sheet 8, both blade pieces 5*a*, 5*b* are overlapped with each other, and the tongue pieces 15*a*, 15*b* of both blade pieces 5*a*, 5*b* are folded toward either one of the blade pieces 5*a* or 5*b* while being overlapped with each other and locked in the cut 16. The pair of blade pieces 5*a*, 5*b* are thereby held in a state of being overlapped with each other.

The impeller-like winding drum 2 shown in FIGS. 6 and 7 is thereby formed. Since the shaft portion core 4 and the blade portions 5 are integrally formed by bending one sheet 8, the winding drum 2 is simple in structure and easy to assemble compared to the case where the winding drum 2 is formed by combining a plurality of separately formed components.

In the winding drum 2, the shaft portion core 4 is formed in a regular hexagonal shape by disposing six shaft pieces 4*a* around the axis L, with adjacent shaft pieces 4*a* in contact with each other, and the central hole 6 also have a regular hexagonal shape. It is also possible to form the shaft portion core 4 in a cylindrical shape by curving the shaft pieces 4*a* in an outwardly convex arc shape. In this case, the central hole 6 is also a circular hole.

Since the width W5 of the blade pieces 5*a*, 5*b* is greater than the width W4 of the shaft pieces 4*a* (see FIG. 3), the height H by which the blade portions 5 extend from the shaft portion core 4 is greater than the diameter of the shaft portion core 4. In other words, when assuming an imaginary circumscribed circle C circumscribing the shaft portion core 4, the diameter of the virtual circumscribed circle C is less than the height H of the blade portions 5. In the illustrated example, the diameter of the virtual circumscribed circle C is about ⅗ of the height H of the blade portions 5.

Since the shaft portion core 4 is formed in this way, its strength is very high owing to the interaction of the plurality of shaft pieces 4*a*. That is, even if winding pressure acts on the shaft portion core 4 through the blade portions 5 when the linear body is wound around the winding drum 2, adjacent shaft pieces 4*a* support each other, and the shaft portion core 4 is thereby not recessed toward the center of the hollow portion at the positions of the blade portions 5. As a result, deformation and crush of the shaft portion core 4 are surely prevented.

Next, the flange plates 3 are sequentially attached to one end and the other end in the direction of the axis L of the winding drum 2. The attachment is performed as shown in FIGS. 8 to 12.

Figure 8:
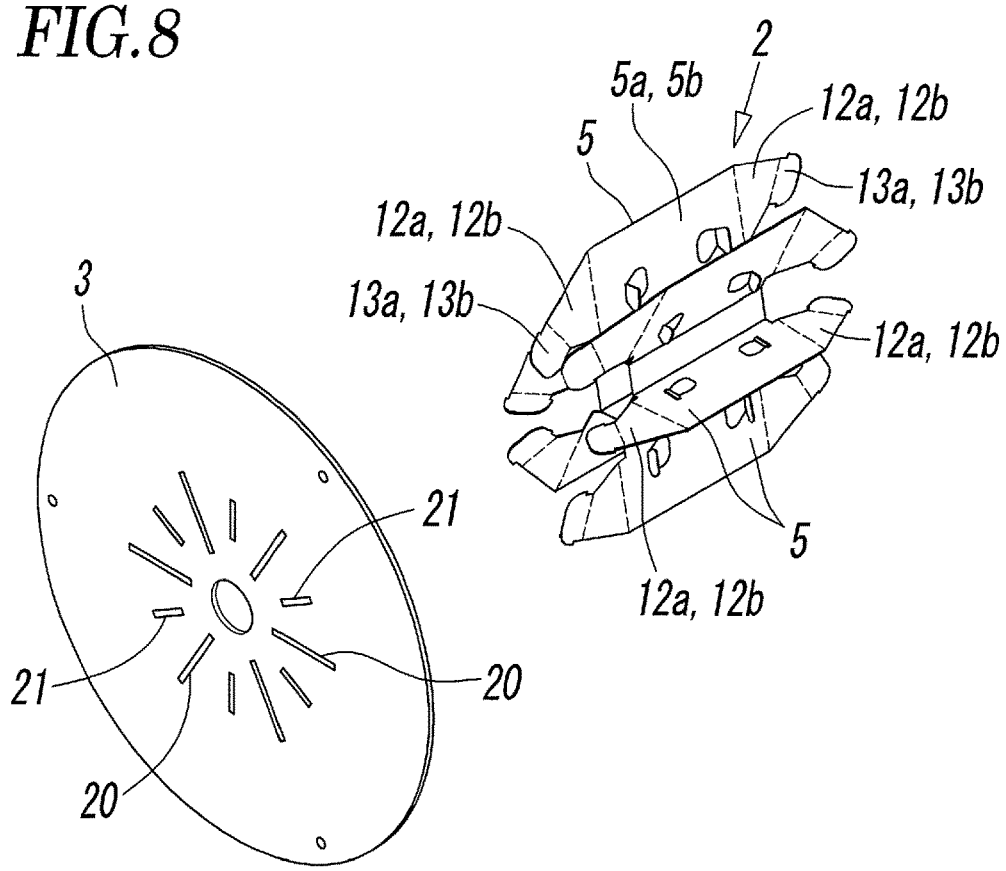
FIG. 8 is a perspective view of the winding drum and the flange plate immediately before attaching the flange plate to one end of the winding drum.
Figure 9:
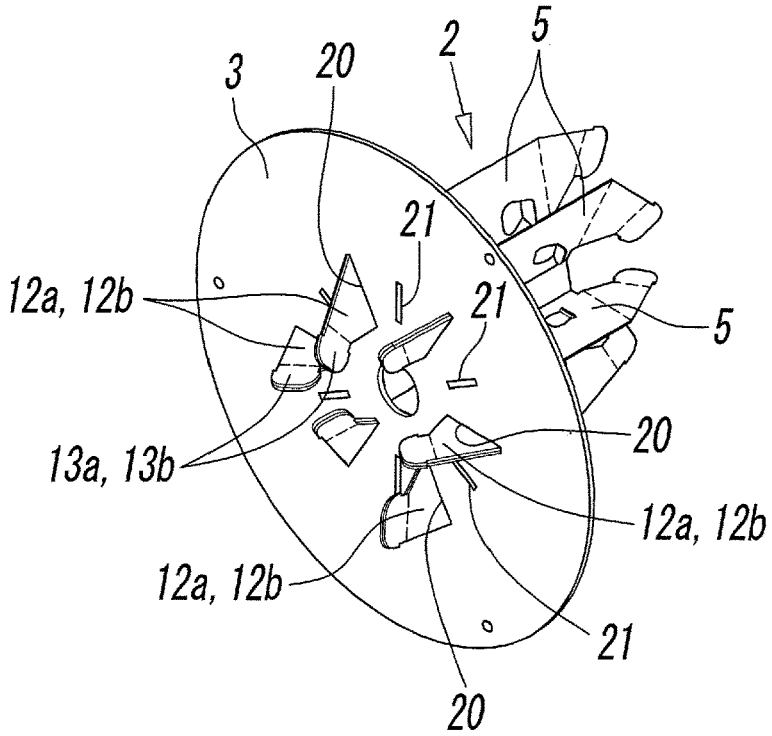
FIG. 9 is a perspective view showing a state in which locking pieces at one end of the winding drum are inserted into insertion holes of the flange plate.
Figure 10:
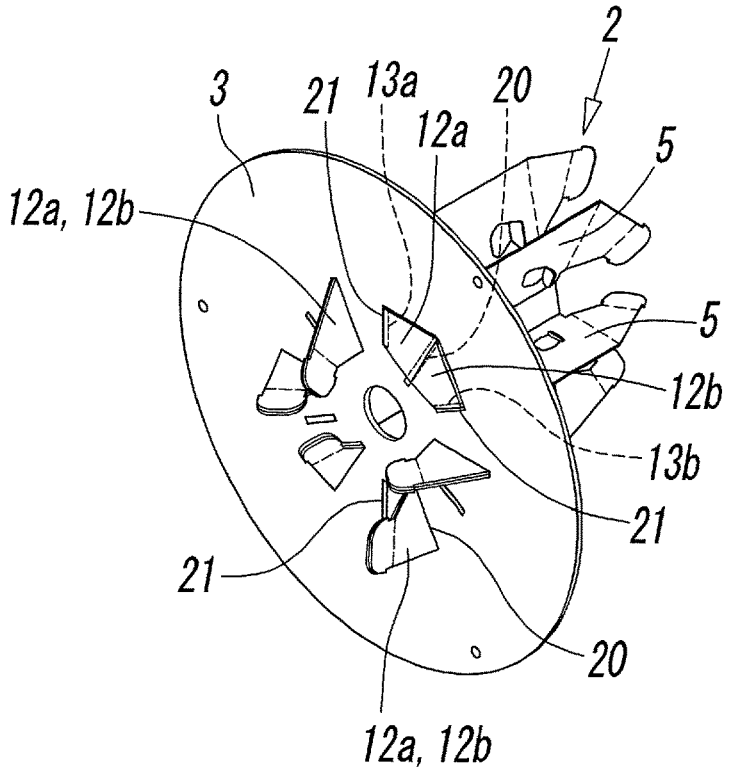
FIG. 10 is a perspective view showing a state in which, from the state of FIG. 9, locking portions at the distal ends of two locking pieces formed in a pair of blade pieces in one blade portion are separately inserted into two locking holes of the flange plate.
Figure 11:
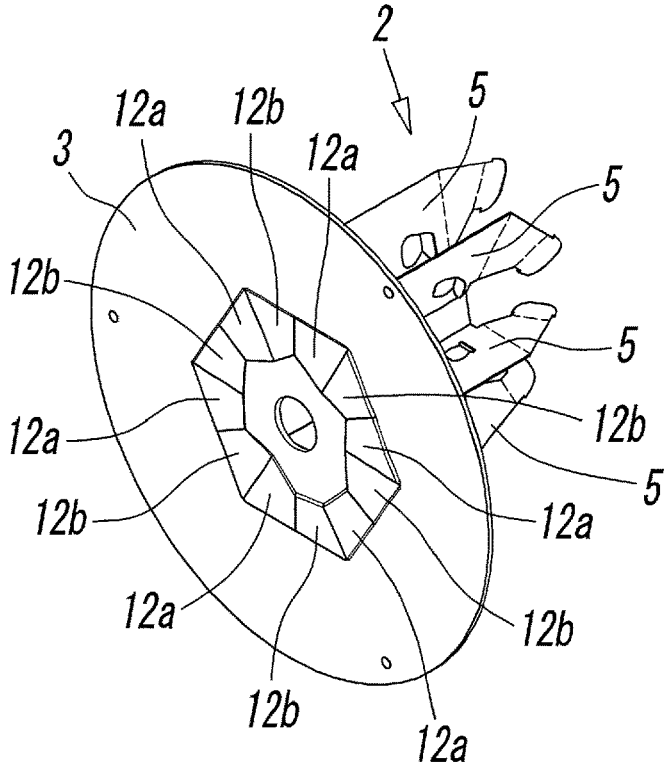
FIG. 11 is a perspective view showing a state in which the flange plate is attached to one end of the winding drum.

First, when attaching the flange plate 3 to one end of the winding drum 2, as shown in FIGS. 8 and 9, the two locking pieces 12*a*, 12*b* continuous with the pair of blade pieces 5*a*, 5*b* of each blade portion 5 are inserted together into one of the insertion holes 20 of the flange plate 3 from the inside to the outside of the flange plate 3 while being overlapped with each other. After that, as shown in FIG. 10, which shows a case where the locking pieces 12*a*, 12*b* of one blade portion 5 located in the upper right are folded, on the outside of the flange plate 3, the two locking pieces 12*a*, 12*b* are folded in opposite directions toward one and the other of the two locking holes 21, 21 located on both sides of the insertion hole 20, the locking portion 13*a* at the distal end of one locking piece 12*a* is inserted into one locking hole 21 from the outside to the inside of the flange plates 3, and the locking portion 13*b* at the distal end of the other locking piece 12*b* is inserted into the other locking hole 21 from the outside to the inside of the flange plates 3. By performing the same work for all the blade portions 5, as shown in FIGS. 2 and 11, the flange plate 3 is attached to one end of the winding drum 2.

At this time, as is clear from FIG. 2, the proximal end portions of the two locking pieces 12*a*, 12*b* of a pair of blade pieces 5*a*, 5*b* in the blade portion 5 are inserted together into each insertion hole 20 of the flange plate 3, and the locking portions 13*a*, 13*b* of the first blade piece 5*a* and the second blade piece 5*b* continuous via the shaft piece 4*a*, of two adjacent blade portions 5 are inserted together into each locking hole 21.

Figure 12:
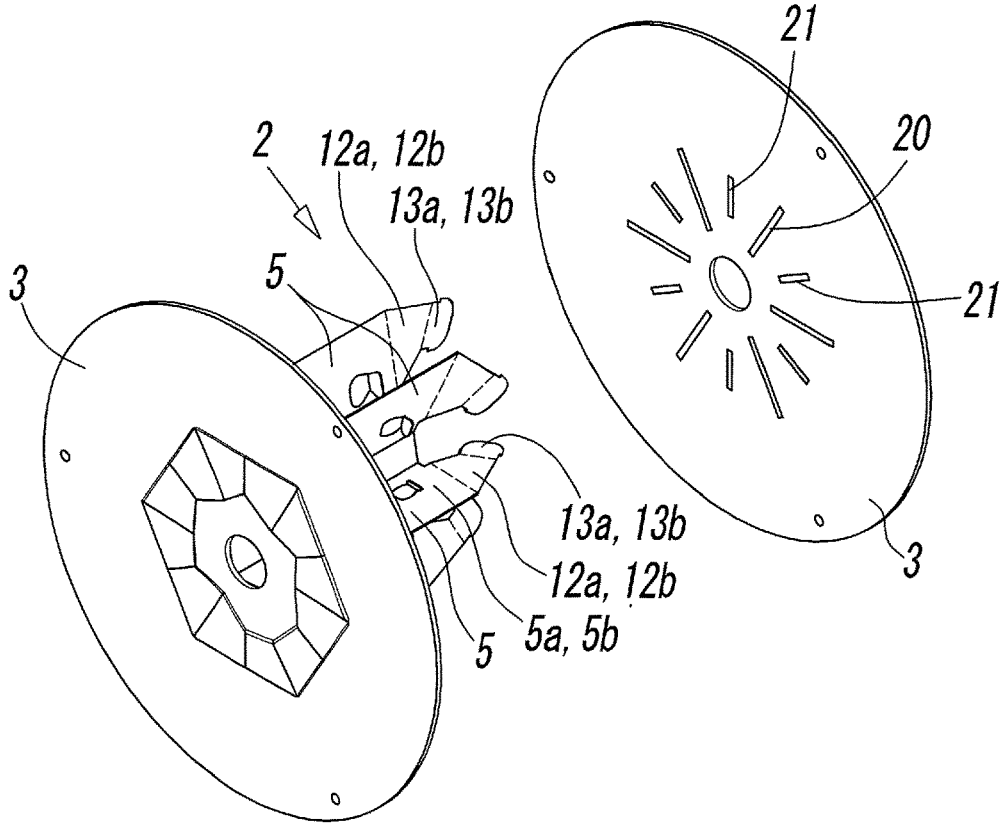
FIG. 12 is a perspective view showing a state immediately before attaching the flange plate to the other end of the winding drum.

Next, as shown in FIG. 12, the flange plate 3 is also attached to the other end of the winding drum 2 in the same manner, and the flange plates 3 are thereby attached to both ends of the winding drum 2.

The reel 1A assembled in this manner is used, for example, for winding a manufactured linear body when manufacturing a flexible linear body such as a tube or a hose made of synthetic resin or rubber used as an air pipe or the like. The linear body is wound so as to surround the plurality of blade portions 5. The wound linear body is transported to a factory or the like and sequentially unreeled from the reel and used. When all of the linear body is used, the reel 1A is discarded.

When winding or unreeling the linear body, a supporting rod is inserted into the central holes 6, 7 of the reel 1A, and the reel 1A can be rotatably supported by the supporting rod.

The thus configured reel 1A has such a configuration that the winding drum 2 has an impeller-like shape and has a plurality of blade portions 5 extending in radial directions from a central shaft portion core 4 and the linear body is wound so as to surround the blade portions 5. Therefore, the strength against the winding pressure of the linear body is significantly high compared to a conventional reel in which the winding drum is cylindrical, and there is no possibility of causing deformation, breakage, or the like.

In particular, since the blade portions 5 are formed by double-folding pairs of plate-like blade pieces 5*a*, 5*b* and are held in a double-folded state by tongue pieces 15*a*, 15*b*, its rigidity is very high. Moreover, since locking pieces 12*a*, 12*b* are inserted together into one insertion hole 20 of the flange plate 3 in a state of being overlapped with each other, and locking portions 13*a*, 13*b* at the distal ends of the locking pieces 12*a*, 12*b* are separately inserted into two locking holes 21 on both sides of the insertion hole 20 and locked, the folded blade pieces 5*a*, 5*b* are reliably held in a state of being in contact with each other, which leads to further enhancement of the support force.

Furthermore, since the shaft portion core 4 is formed by disposing a plurality of shaft pieces 4*a* in a state of being in contact with each other such that they surround the axis L, high strength is exerted against the winding pressure acting through the blade portions 5 by the interaction of adjacent shaft pieces 4*a*. Therefore, as described above, even when a support rod is inserted into the center hole 6 of the shaft portion core 4 during winding and unreeling of the linear body, the shaft portion core 4 does not break.

Although, in the illustrated example, six blade portions 5 of the winding drum 2 are formed, the number of the blade portions 5 may be a number other than six as long as it is three or more.

Although, in the illustrated example, tongue pieces 15*a*, 15*b* are formed at positions that face each other of the pair of blade pieces 5*a*, 5*b* forming each blade portion 5, the pair of blade pieces may be locked to each other by forming a tongue piece in either one of the blade pieces, forming a locking hole in the other blade piece, and inserting and locking the tongue piece into the locking hole. Alternatively, a tongue piece and a locking hole may be formed at separate positions of either one of the blade pieces, a locking hole and a tongue piece may be formed at positions corresponding to the tongue piece and the locking hole of the other blade piece, and the tongue pieces and the locking holes of both blade pieces may be locked to each other.

If it is necessary to increase the strength of the left and right flange plates 3, a method such as using corrugated cardboard having higher strength than the corrugated cardboard forming the winding chum 2, or using a plurality of (for example two) flange plates 3 having the same configuration in a stacked manner can be used. When a plurality of flange plates are used in a stacked manner, the stacked flange plates may be fixed to each other with an adhesive or the like.

Figure 13:
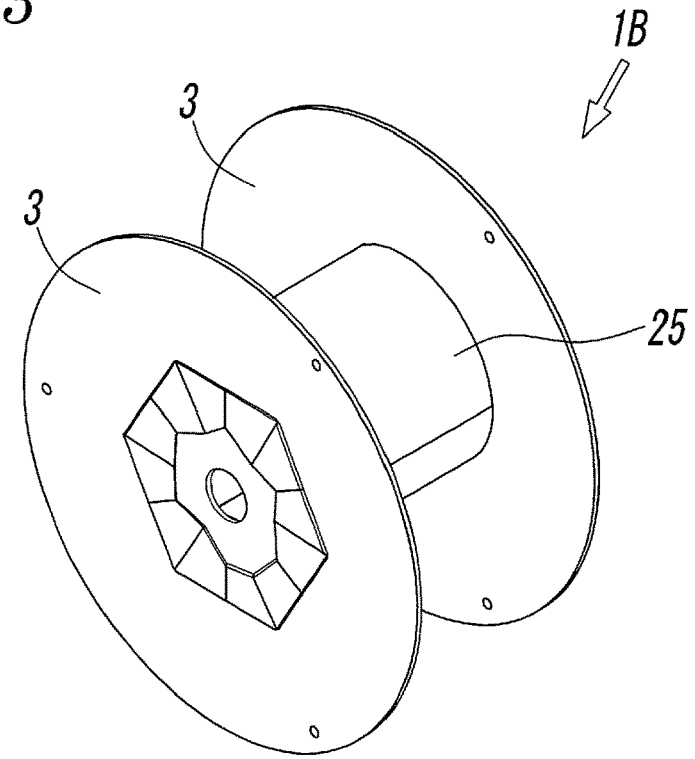
FIG. 13 is a perspective view showing a second embodiment of a paper-made reel according to the present invention.
Figure 14:
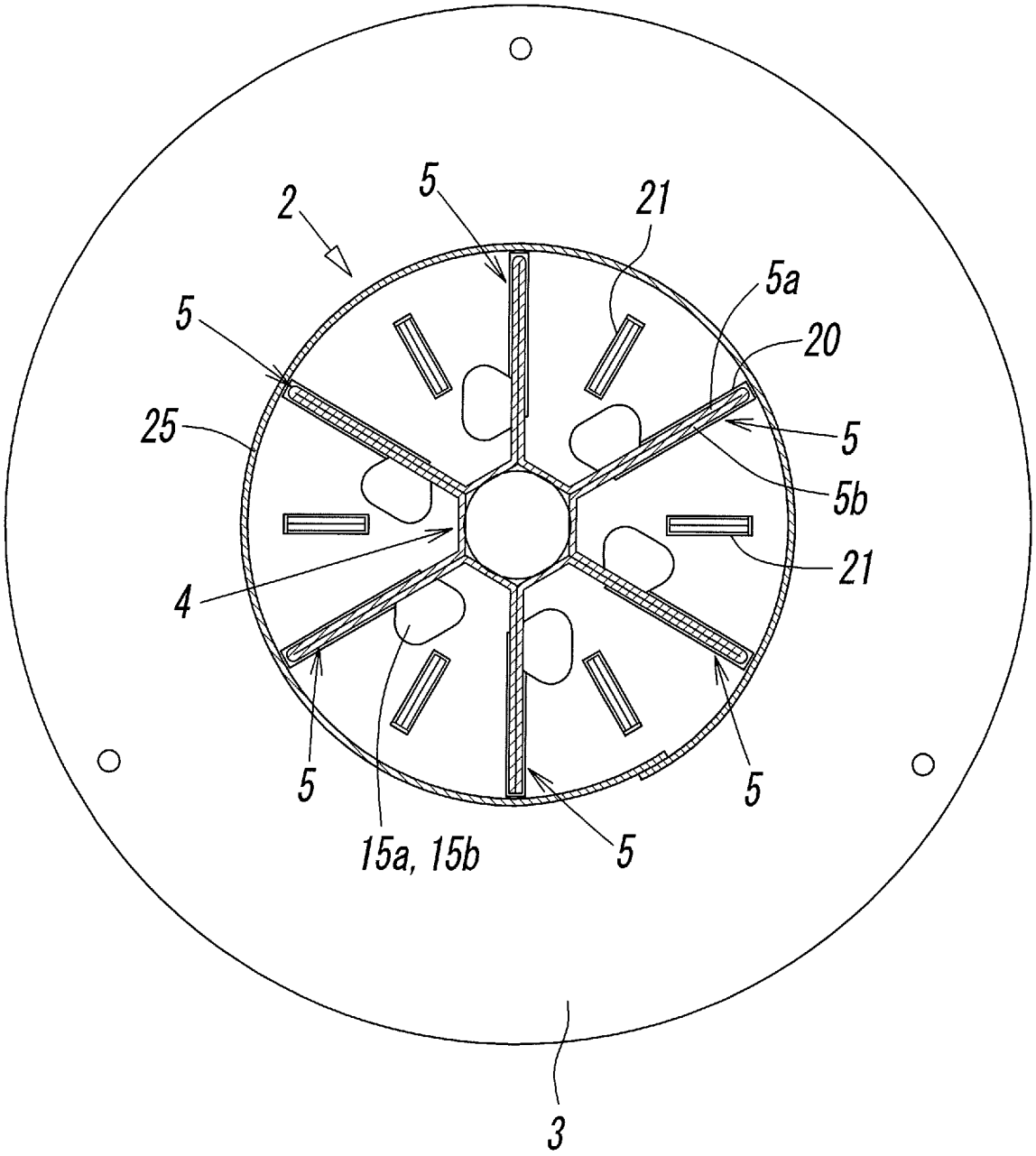
FIG. 14 is an enlarged sectional view of FIG. 13.

FIGS. 13 and 14 show a second embodiment of a paper-made reel according to the present invention. The reel 1B of the second embodiment differs from the reel 1A of the first embodiment in that a cylindrical body 25 made of paper is attached to the outer periphery of an impeller-like winding drum 2 so as to surround the distal ends of a plurality of blade portions 5. Since, in other respects, the reel 1B of the second embodiment is the same as the reel 1A of the first embodiment including modification examples and the like, the same reference signs will be used to denote the same main components as those of the reel 1A of the first embodiment, and the description thereof will be omitted.

The cylindrical body 25 is formed by rounding a flat paperboard having a thickness of about 1 mm into a cylindrical shape, and the length of the cylindrical body 25 in the direction of the axis L is about the same as the length of the blade portions 5 in the winding drum 2 in the direction of the axis L. The attachment of the cylindrical body 25 to the reel 1A is performed by assembling the winding drum 2 and attaching one of the flange plates 3 to one end thereof, and then fitting the cylindrical body 25 on the outer periphery of the blade portions 5 from the other end of the winding drum 2. After that, the other flange plate 3 is attached to the other end of the winding drum 2.

Figure 1:
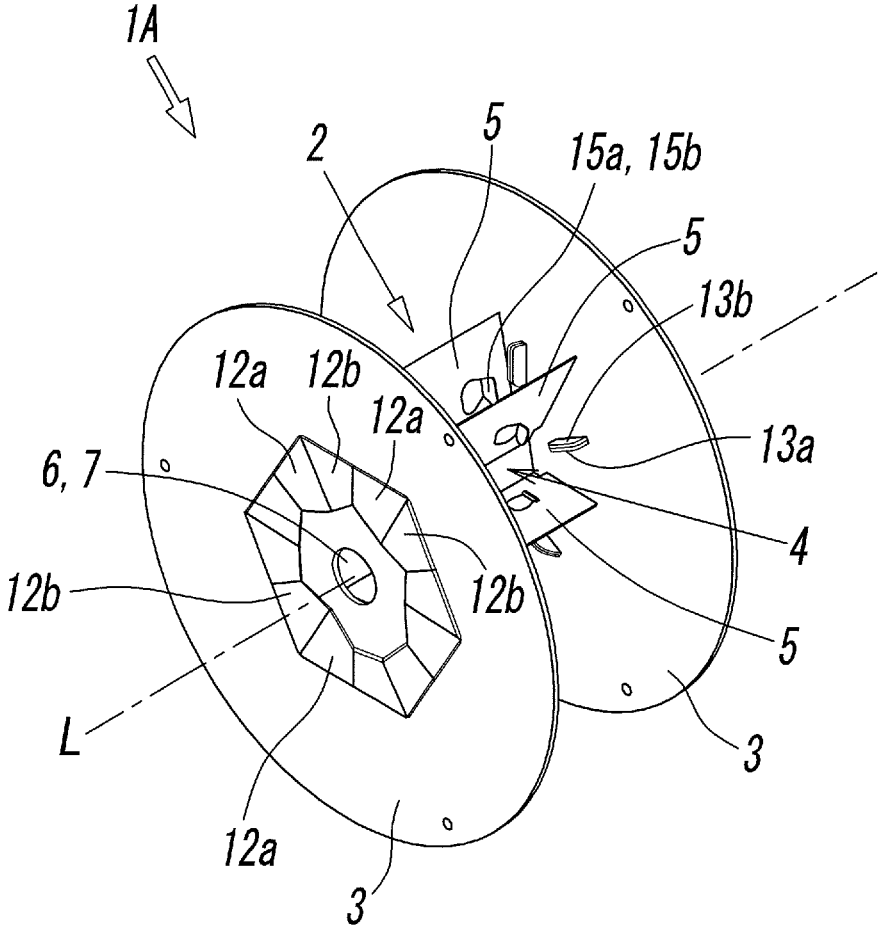
FIG. 1 is a perspective view showing a first embodiment of a paper-made reel according to the present invention.

However, the cylindrical body 25 may be formed by wrapping a flat paperboard around the outer periphery of the winding drum 2 after assembling the reel 1A shown in FIG. 1.

The inside diameter of the cylindrical body 25 may be about the same as the diameter of an imaginary circle in contact with the distal ends of the plurality of blade portions 5, but may be slightly greater than the diameter of the imaginary circle. In the former case, the cylindrical body 25 is attached to the winding drum 2 in a substantially tight manner. In the latter case, the cylindrical body 25 is attached to the winding drum 2 with a slight clearance therebetween.

By attaching such a cylindrical body 25 to the winding drum 2, when winding a flexible linear body such as a tube made of synthetic resin, the linear body is prevented from being pressed directly against the distal ends of the blade portions 5. As a result, disadvantages such as crush and deformation of the linear body are avoided.

Since the cylindrical body 25 itself does not form the winding drum 2 by itself, the cylindrical body 25 does not necessarily have to have a rigidity high enough to withstand the winding pressure of the linear body when winding the linear body on the cylindrical body 25, and may have such a rigidity that when the winding pressure of the linear body acts, the cylindrical body 25 is deformed inward and is pressed against the distal ends of the blade portions 5. The cylindrical body 25 may be formed of corrugated cardboard.

REFERENCE SIGNS LIST

1A, 1B reel
2 winding drum
3 flange plate
4 shaft portion core
4*a* shaft piece
5 blade portion
5*a* first blade piece
5*b* second blade piece

6 central hole
8 sheet
12*a*, 12*b* locking piece
13*a*, 13*b* locking portion
15*a*, 15*b* tongue piece
20 insertion hole
21 locking hole
25 cylindrical body
L axis
H height of blade portion
C imaginary circumscribed circle

The invention claimed is:

1. A paper-made reel comprising:

an impeller-like winding drum made of paper for winding a flexible linear body; and flange plates made of paper attached to one end and the other end in a direction of an axis of the winding drum, wherein the winding drum has a hollow shaft portion core, and a plurality of blade portions extending radially outward from an outer periphery of the shaft portion core, wherein the shaft portion core and the blade portions are integrally formed by folding a sheet cut into such a shape that shaft pieces forming the shaft portion core and pairs of blade pieces forming the blade portions are alternately continued, wherein the shaft portion core is formed in a hollow shape by disposing the shaft pieces around the axis with adjacent shaft pieces in contact with each other, wherein the blade portions are formed by double-folding the pairs of blade pieces, and extend along the axis and over the entire length of the shaft portion core, and wherein locking pieces for connection are formed at both ends in an axial direction of the winding drum, and the winding drum and the flange plates are connected by locking the locking pieces to the flange plates.

2. The paper-made reel according to claim 1, wherein a width of the shaft pieces is less than a height of the blade portions extending from the shaft portion core, and a diameter of an imaginary circumscribed circle circumscribing the shaft portion core is also less than the height of the blade portions.

3. The paper-made reel according to claim 1, wherein the pair of blade pieces forming each blade portion are held in a state of being overlapped with each other by locking a tongue piece formed in one of the blade pieces to a tongue piece of the other blade piece.

4. The paper-made reel according to claim 3, wherein the tongue pieces are formed at positions that face each other of the pair of blade pieces, the tongue pieces of the pair of blade pieces are folded toward either one of the blade pieces while being overlapped with each other, the tongue piece of one of the blade pieces is thereby locked to the tongue piece of the other blade piece, and the pair of blade pieces are held in a state of being overlapped with each other.

5. The paper-made reel according to claim 3, wherein the tongue pieces are formed at a plurality of positions of each blade portion.

6. The paper-made reel according to claim 1, wherein the locking pieces are formed at both side end portions of a pair of blade pieces of the pairs of blade pieces and have locking portions at their distal ends, wherein, in a flange plate of the flange plates, insertion holes into which proximal end portions of the locking pieces are inserted and locking holes into which the locking portions are inserted are alternately formed around the axis, and wherein the locking pieces of the blade pieces are inserted into the insertion holes of the flange plate from the inside to the outside of the flange plate and are then folded in the directions of the locking holes, the locking portions at the distal ends of the locking pieces are inserted into the locking holes from the outside to the inside of the flange plate, and the winding drum and the flange plate are thereby connected to each other.

7. The paper-made reel according to claim 6, wherein a number of the insertion holes of the flange plate and a number of the locking hole of the flange plate are equal to a number of the blade portions, and are equal to each other, and wherein the proximal end portions of the two locking pieces formed in the pair of blade pieces in each blade portion are inserted together into one of the insertion holes while being overlapped with each other, and the locking portions at the distal ends of the two locking pieces are separately inserted into the locking holes located on both sides of the insertion hole, and are inserted together with the locking portion of a locking piece of the locking pieces formed in one of the pair of blade pieces in an adjacent blade portion.

8. The paper-made reel according to claim 1, wherein a cylindrical body made of paper is attached to an outer periphery of the winding drum so as to surround distal ends of the plurality of blade portions.

* * * * *